US008485327B1

(12) United States Patent
Dalrymple

(10) Patent No.: US 8,485,327 B1
(45) Date of Patent: Jul. 16, 2013

(54) LUGGAGE WITH INTEGRATED EATING SURFACE

(76) Inventor: Tiffany Dalrymple, Denver, CO (US)

( * ) Notice: Subject to any disclaimer, the term of this patent is extended or adjusted under 35 U.S.C. 154(b) by 555 days.

(21) Appl. No.: 12/765,039

(22) Filed: Apr. 22, 2010

(51) Int. Cl.
*A45F 4/00* (2006.01)

(52) U.S. Cl.
USPC ..... 190/11; 190/8; 190/12 A; 190/111; 190/110

(58) Field of Classification Search
USPC ..... 190/8, 11, 12 A, 12 R, 110, 112
See application file for complete search history.

(56) References Cited

U.S. PATENT DOCUMENTS

| | | | | |
|---|---|---|---|---|
| 327,749 | A * | 10/1885 | Wulff | 190/10 |
| 1,038,880 | A * | 9/1912 | Hansen | 190/8 |
| 1,140,997 | A * | 5/1915 | Minehart | 190/8 |
| 1,834,740 | A * | 12/1931 | Rhett | 190/107 |
| 4,890,705 | A * | 1/1990 | Pineda | 190/18 A |
| 5,551,558 | A * | 9/1996 | Bureau | 206/223 |
| 5,826,770 | A * | 10/1998 | Chuang | 224/607 |
| 6,279,706 | B1 * | 8/2001 | Mao | 190/115 |
| 6,298,964 | B1 * | 10/2001 | Sadow | 190/18 A |
| 6,341,817 | B1 * | 1/2002 | Stern-Gonzalez | 297/188.1 |
| 6,390,431 | B1 | 5/2002 | Ott | |
| 6,471,019 | B1 | 10/2002 | Miller | |
| 6,481,239 | B2 * | 11/2002 | Hodosh et al. | 62/457.4 |
| 6,604,472 | B2 | 8/2003 | McNeil | |
| 6,659,319 | B2 * | 12/2003 | Purpura | 224/576 |
| D485,432 | S * | 1/2004 | Desrochers | D3/216 |
| 6,736,073 | B2 | 5/2004 | Ryburg | |
| D492,486 | S | 7/2004 | Mullins | |
| 7,309,106 | B2 * | 12/2007 | Stallman | 297/310 |
| 7,510,157 | B2 | 3/2009 | Oliver | |
| 2006/0219745 | A1 | 10/2006 | Riley | |
| 2009/0289480 | A1 * | 11/2009 | McFarland et al. | 297/255 |

* cited by examiner

*Primary Examiner* — Tri Mai
(74) *Attorney, Agent, or Firm* — Kyle Fletcher

(57) ABSTRACT

The luggage with integrated eating surface includes a standard piece of wheeled luggage having an eating surface that folds out from a top surface of the wheeled luggage. The top surface of the luggage folds upwards to reveal the eating surface and cup holder. The eating surface is suspended above an inner surface, which protects the contents of the luggage from liquids and other debris. The suspension of the eating surface from the inner surface also enables a cup or container to hang from the cup holder.

12 Claims, 4 Drawing Sheets

LUGGAGE WITH INTEGRATED EATING SURFACE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of luggage, more specifically, luggage having an integrated eating surface.

B. Discussion of the Prior Art

As a preliminary note, it should be stated that there is an ample amount of prior art that deals with luggage, generally. As will be discussed immediately below, no prior art discloses luggage, which has an eating surface that folds out from a top surface of said luggage and of which further includes a cup holder and sides that extend upward from said eating surface.

The Oliver patent (U.S. Pat. No. 7,510,157) discloses a self-leveling cup holder that is mountable onto the top of an extendable handle of a piece of wheeled luggage. However, the cup holder attaches to the handle of a piece of luggage as opposed to an eating surface that extends from a top of said luggage.

The Ott patent (U.S. Pat. No. 6,390,431) discloses a device for removably holding a beverage container in an upright position upon a telescoping upright handle of a wheeled luggage unit. Again, the beverage container holder attaches onto the handle of the piece of wheeled luggage as opposed to an eating surface that extends from a top surface of said piece of luggage.

The McNeil patent (U.S. Pat. No. 6,604,472) discloses a computer table attachable to a piece of luggage standing in an upright position. However, the computer table is not integrated into the top surface of the luggage, and does not include a cup holder or protective sides that extend upwards from said luggage.

The Riley patent Application Publication (U.S. Pub. No. 2006/0219745) discloses a carry-on luggage having a beverage container holder. However, the beverage container holder for the carry-on luggage does not fold out from a top surface of the luggage to provide an eating surface and sides that extend upwards from multiple sides to protect any items resting upon said eating surface.

The Ryburg patent (U.S. Pat. No. 6,736,073) discloses a work surface for luggage and luggage carriers. However, the work surface is not integrated within and folds out from a top surface of the luggage in order to provide an eating surface and beverage holder.

The Miller patent (U.S. Pat. No. 6,471,019) discloses a travel case having a deployable and retractable tray table assembly mounted to the back of the housing. Again, the travel case does not have an eating surface integrated into a top surface of said luggage and of which folds out to provide a cup holder, eating surface, and protective sides.

The Mullins patent (U.S. Pat. No. Des. 492,486) illustrates an ornamental design for a piece of luggage, which does not depict an eating surface that folds out from a top surface.

While the above-described devices fulfill their respective and particular objects and requirements, they do not describe a luggage, which has an eating surface that folds out from a top surface of said luggage and of which further includes a cup holder and sides that extend upward from said eating surface. In this regard, the luggage with integrated eating surface departs from the conventional concepts and designs of the prior art.

SUMMARY OF THE INVENTION

The luggage with integrated eating surface includes a standard piece of wheeled luggage having an eating surface that folds out from a top surface of the wheeled luggage. The top surface of the luggage folds upwards to reveal the eating surface and cup holder. The eating surface is suspended above an inner surface, which protects the contents of the luggage from liquids and other debris. The suspension of the eating surface from the inner surface also enables a cup or container to hang from the cup holder.

It is an object of the invention to provide an eating surface that is integrated into the top surface of a piece of luggage.

A further object of the invention is to provide a cup holder integrated into the eating surface.

A further object of the invention is to provide a plurality of protective sides that extend to protect items placed on the eating surface or in the cup holder.

A further object of the invention is to provide a top surface, which folds upwards upon unfastening a fastening means to reveal the top surface.

These together with additional objects, features and advantages of the luggage with integrated eating surface will be readily apparent to those of ordinary skill in the art upon reading the following detailed description of presently preferred, but nonetheless illustrative, embodiments of the luggage with integrated eating surface when taken in conjunction with the accompanying drawings.

In this respect, before explaining the current embodiments of the luggage with integrated eating surface in detail, it is to be understood that the luggage with integrated eating surface is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the luggage with integrated eating surface.

It is therefore important that the claims be regarded as including such equivalent construction insofar as they do not depart from the spirit and scope of the luggage with integrated eating surface. It is also to be understood that the phraseology 10 and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A luggage with integrated eating surface 10 (hereinafter invention) includes a piece of luggage 11 (hereinafter luggage) having a top surface 12.

Figure 1:
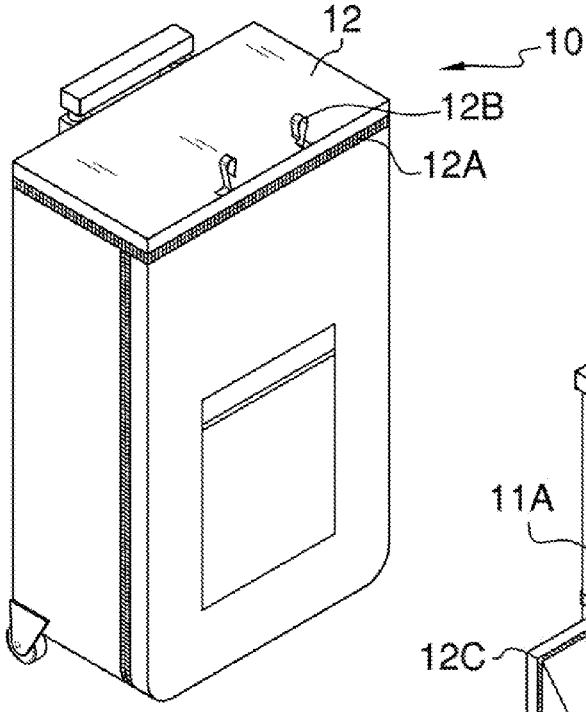
FIG. 1 illustrates a front, isometric view of the luggage with integrated eating surface with the eating surface folded flat upon the top surface and using a zipper as the fastening means.
Figure 1A:
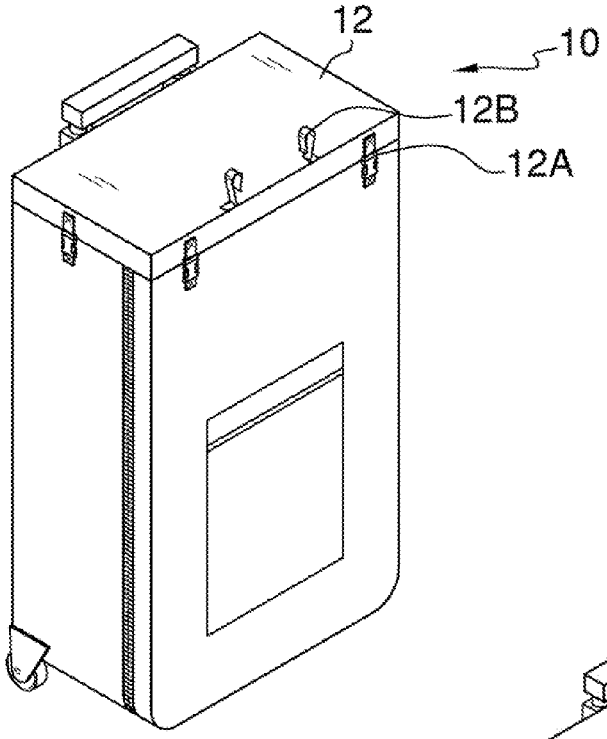
FIG. 1A illustrates a front, isometric view of the luggage with integrated eating surface with the eating surface folded flat upon the top surface and using a plurality of clasps as the fastening means.
Figure 1B:
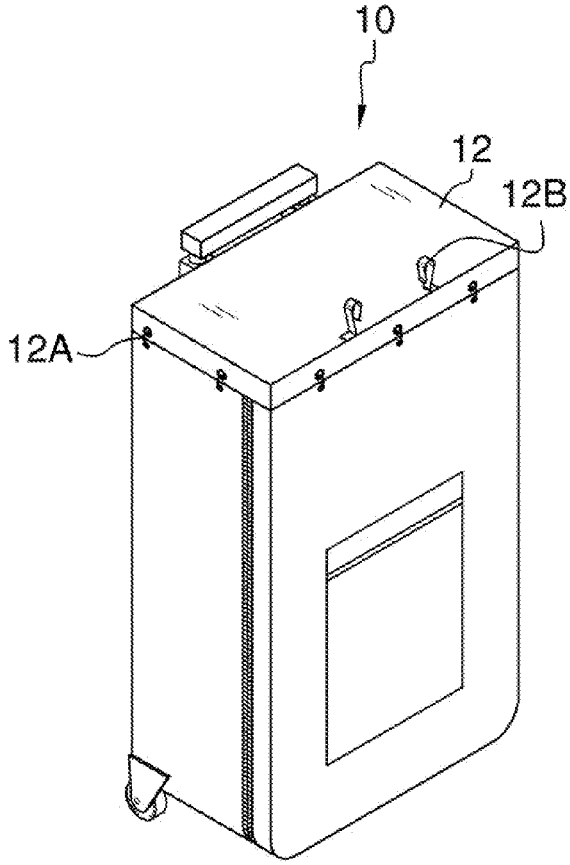
FIG. 1B illustrates a front, isometric view of the luggage with integrated eating surface with the eating surface folded flat upon the top surface and using a plurality of hook and grommets as the fastening means.
Figure 3:
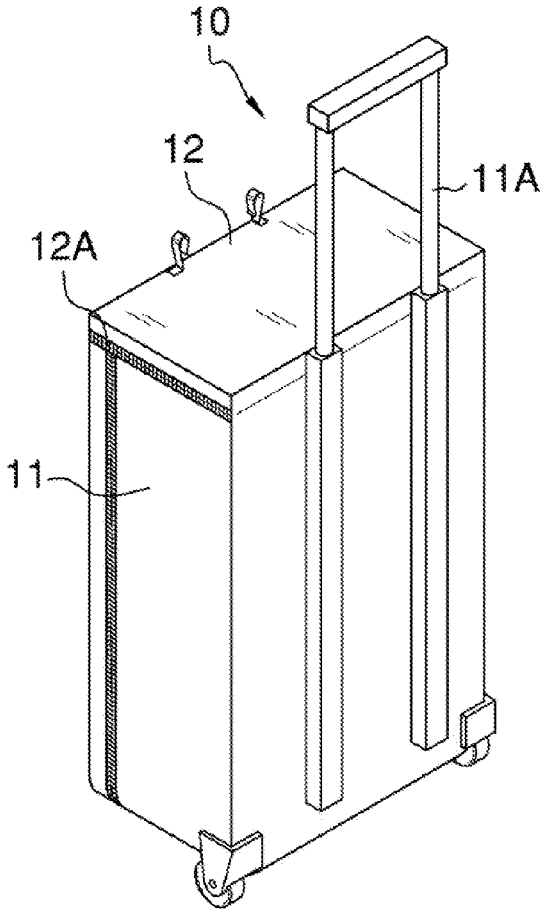
FIG. 3 illustrates a rear, isometric view of the luggage with integrated eating surface with the top surface folded down flat to conceal the eating surface.

The top surface 12 is secured to the luggage 11 via a fastening means 12A comprising (1) a zipper that runs around a front side, left side, and/or right side (see FIG. 1); (2) a clasp that adorns a front side, left side, or right side (see FIG. 1A); or (3) a hook and grommet that adorns a front side, left side, or right side (see FIG. 1B).

The luggage 11 may resemble a traditional suitcase or a more modern form of luggage that includes wheels and a handle 11A.

Figure 2:
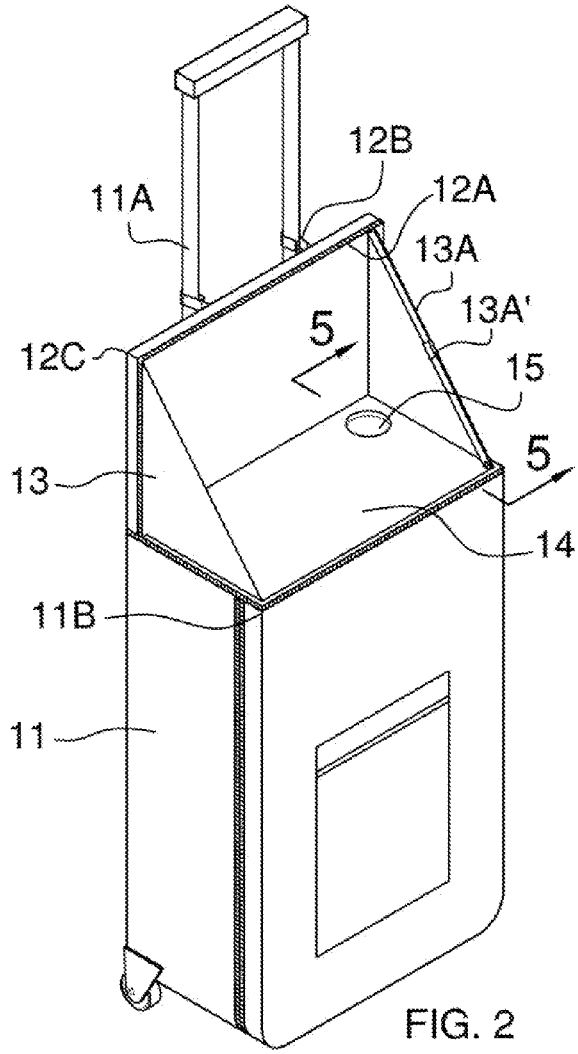
FIG. 2 illustrates a front, isometric view of the luggage with integrated eating surface with the top surface folded up to reveal the eating surface, cup holder, and protective sides.
Figure 4:
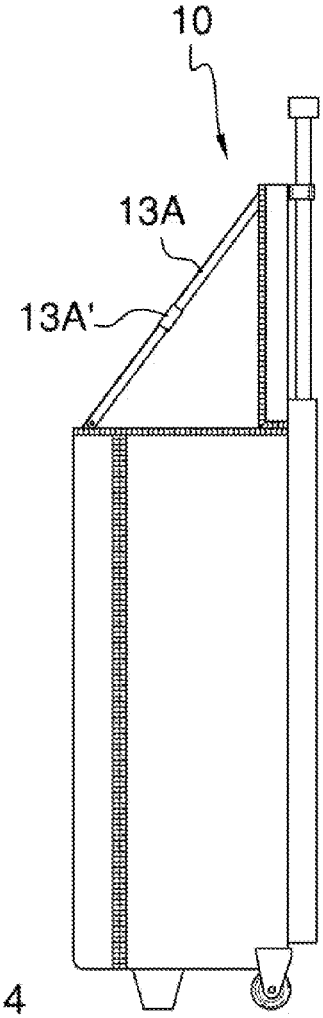
FIG. 4 illustrates a side view of the luggage with integrated eating surface with the top surface folded up and detailing the protective sides.
Figure 5:
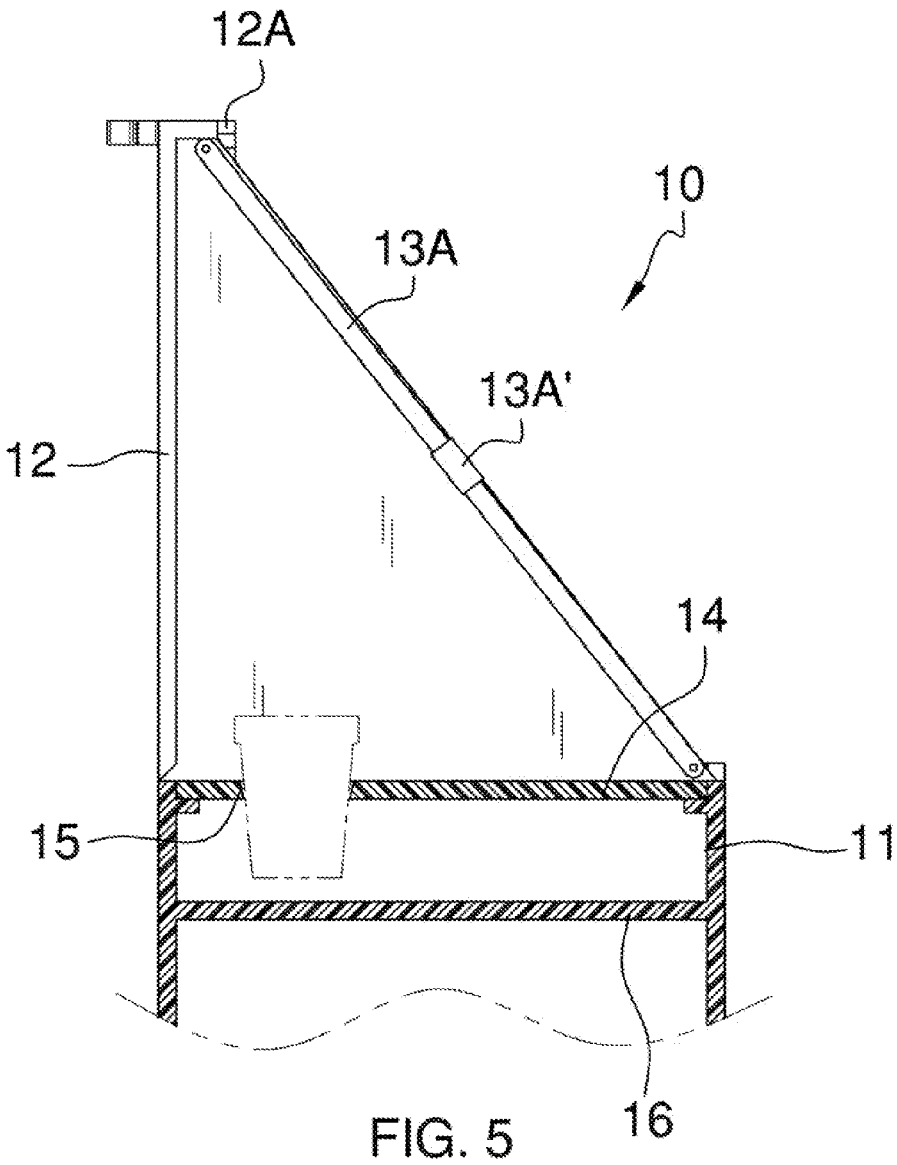
FIG. 5 illustrates a cross-sectional view of the luggage with integrated eating surface along line 5-5 in FIG. 4, and depicting a cup contained within the cup holder.

When the top surface 12 is unfastened from the fastening means 12A, the top surface 12 can fold upwards (see FIGS. 2, 4, and 5). When the top surface 12 is folded upwards, at least one clip 12B. The clip(s) 12B are used to secure the top surface 12 to the handle 11B (See FIGS. 2 and 5). However, if the luggage 11 is not outfitted with a handle 11B, other securing means are available, and will be discussed below.

Protective sides 13 extend from a left side and a right side of the luggage 11 and top surface 12. The protective sides 13 form a triangular pattern, wherein a diagonal side exists from a front corner 12C of the top surface 12 to a top, front corner of the luggage 11. The protective sides 13 are made of a flexible fabric.

Other securing means are integrated into the protective sides 13, in the event the luggage 11 is not outfitted with the handle 11B. The securing means include reinforcing rods 13A that extend lengthwise when the top surface 12 is folded upwards to reveal an eating surface 14. The reinforcing rods 13A fold about a lockable hinge 13A' to enable the reinforcing rods 13A to support the top surface 12 in an upward position (when locked in an extended state) or to fold down when in a retracted state (when the top surface 12 is folded down onto the luggage 11).

The eating surface 14 is located under the top surface 12, and is revealed or accessible only after the top surface 12 is folded upwards (see FIGS. 2, 4, and 5). The eating surface 14 includes a cup holder 15. The cup holder 15 consists of a pre-defined circular opening of a set diameter, which is located in one of the corners of the eating surface 14. The cup holder 15 is capable of supporting in an upright position a cup 30 or other liquid container, which may fit within the cup holder 15 (aluminum can, plastic bottle, etc.). The eating surface 14 is made of a material comprising a woven fabric, plastic, metal, wood, or carbon fiber composite.

Situated below the eating surface 14 is an inner surface 16 (see FIG. 5). The inner surface 16 serves two purposes, the first of which is to provide a bottom surface from which a cup 30 or plastic bottle or aluminum can that may rest upon provided the overall diameter of the cup et al. is less than or equal to the diameter of the cup holder 15. The second purpose of the inner surface 16 is to seal against unwanted foods, liquids, or other debris from falling down from the eating surface 14, and into an interior of the luggage 11. The inner surface 16 is made of a material comprising a woven fabric, plastic, metal, wood, or carbon fiber composite.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A luggage with integrated eating surface comprising:

a top surface, which folds upwards to reveal an eating surface contained there under;

wherein protective sides extend to protect materials contained upon said eating surface;

wherein said top surface is folded upon and fastened to said luggage via a fastening means;

wherein the fastening means comprises a zipper that runs around a front side, left side, and/or right side of said top surface; a clasp that adorns a front side, left side, or right side of said top surface; or a hook and grommet that adorns a front side, left side, or right side of said top surface;

wherein the eating surface includes a cup holder comprising a circular opening located on the eating surface;

wherein the cu holder is located at a corner of the eating surface;

wherein the eating surface is suspended above an inner surface;

wherein the inner surface seals the contents of the luggage from materials contained on the eating surface and cup holder;

wherein the luggage is wheeled and includes an extendable handle;

wherein the top surface has at least one clip that clips onto the handle to secure the top surface when folded upwards.

2. The luggage with integrated eating surface as described in claim 1 wherein the inner surface is made of a material comprising a flexible fabric, metal, wood, plastic, or carbon fiber composite.

3. The luggage with integrated eating surface as described in claim 1 wherein the protective sides extend at each side of the luggage.

4. The luggage with integrated eating surface as described in claim 3 wherein the protective sides form a triangle that is formed along a side of the eating surface, a side of the top surface, and a diagonal formed between the eating surface and the top surface.

5. The luggage with integrated eating surface as described in claim 4 wherein the diagonal of the protective sides is outfitted with a reinforcing rod that extends to ensure that the top surface folds upwards, and therefore to protect the eating surface and materials contained thereon.

6. The luggage with integrated eating surface as described in claim 1 wherein the protective sides are made of a material comprising a flexible fabric.

7. The luggage with integrated eating surface as described in claim 1 wherein the eating surface is made of a material comprising a flexible fabric, plastic, wood, carbon fiber composite, or a metal.

8. A luggage with integrated eating surface comprising:

a top surface, which folds upwards to reveal an eating surface contained there under;

wherein protective sides extend to protect materials contained upon said eating surface;

wherein said top surface is folded upon and fastened to said luggage via a fastening means;

wherein the eating surface includes a cup holder comprising a circular opening located on one of the corners of the eating surface;

wherein the eating surface is suspended above an inner surface, which seals the contents of the luggage from materials contained on the eating surface and cup holder;

wherein the protective sides extend at each side of the luggage to form a triangle that is formed along a side of the eating surface, a side of the top surface, and a diagonal formed between the eating surface and the top surface;

wherein the luggage is wheeled and includes an extendable handle;

wherein the top surface has at least one clip that clips onto the handle to secure the to surface when folded upwards.

9. The luggage with integrated eating surface as described in claim 8 wherein the fastening means comprises a zipper that runs around a front, side, left side, and/or right side of said top surface; a clasp that adorns a front side, left side, or right side of said top surface; or a hook and grommet that adorns a front side, left side, or right side of said top surface.

10. The luggage with integrated eating surface as described in claim 8 wherein the inner surface is made of a material comprising a flexible fabric, metal, wood, plastic, or carbon fiber composite.

11. The luggage with integrated eating surface as described in claim 8 wherein the protective sides are made of a material comprising a flexible fabric.

12. The luggage with integrated eating surface as described in claim 8 wherein the eating surface is made of a material comprising a flexible fabric, plastic, wood, carbon fiber composite, or a metal.

* * * * *